United States Patent [19]

Copp

[11] 4,173,271

[45] Nov. 6, 1979

[54] VENDING MACHINE FOR FABRIC-LIKE ARTICLES AND METHOD

[76] Inventor: Queve E. Copp, 3470 Thornwood Dr., Atlanta, Ga. 30340

[21] Appl. No.: 839,600

[22] Filed: Oct. 5, 1977

[51] Int. Cl.[2] ..... G07F 7/06

[52] U.S. Cl. ..... 194/4 C

[58] Field of Search ..... 194/4 R, 4 C, 4 G

[56] References Cited

U.S. PATENT DOCUMENTS 3,794,148 2/1974 Copp ..... 194/4 C

*Primary Examiner*—Stanley H. Tollberg

*Attorney, Agent, or Firm*—Patrick F. Henry

[57] ABSTRACT

An electrically operated shop towel vending machine for dispensing a clean shop towel only in response to the proper input of the satisfactory dirty shop towel which is inspected as to length, strength, texture and/or bulk. The input section comprises an inspection mechanism which employs a continuous chain on which a towel is hooked passing beneath an inspection wheel which operates a sprocket and measuring chain only in response to proper actuation of the wheel to activate electrical switches indicating that a proper towel has been inserted. The delivery section of the machine comprises a continuously moving pickup conveyor which delivers the towel from a pile of towels to a transfer roll which employs an arrangement of card cloth patches with the needles projecting in predetermined directions in cooperation with a transfer belt and a discharge roll to separate and shed more than one towel so that only one towel is discharged from the cabinet past an electric eye or photocell to stop the machine.

23 Claims, 12 Drawing Figures

VENDING MACHINE FOR FABRIC-LIKE ARTICLES AND METHOD

BACKGROUND OF THE INVENTION

1. Field of the Invention

The field of the invention is generally vending machines particularly anomalous check-controlled apparatus (Class 194, Subclass 4C).

2. Description of the Prior Art

There are numerous vending machines in the prior art for receiving fabric-like articles such as shop towels and dispensing same so that it is necessary to place a dirty towel in the machine in order to receive the clean towel in return. Such machines are very advantageous in factories and shops where large quantities of shop towels are being used daily. U.S. Pat. 3,794,148 discloses such a machine which employs a measuring section or unit in which a chain with towel pickups elongates the towel beneath the measuring wheel to rotate a gear arrangement. This particular mechanism has been changed in the present apparatus in order to provide a different apparatus employing an elongated measuring chain driven by a sprocket to elongate a coil spring to inspect the input towel and to return the mechanism to proper initial position each time. In the aforementioned patent there is a delivery section which employs a shedding or towel separation apparatus which like the present shedding apparatus picks up towels continuously from a pile and this arrangement has been changed and revised somewhat in order to provide a lower towel feed belt operated from an eccentric and ratchet arrangement so that towels are picked up from a conveyor continuously and delivered to a shedding or towel separation arrangement which employs a transfer belt, discharge roll, transfer roll and the transfer roll is provided with a reverse card cloth arrangement to hold a second towel back to stop double delivery. Thus, a different way has been found from that disclosed in the aforementioned patent to inspect the input towel and also a variation in the way that towels are picked up from a stack, separated and moved so that only one towel is dispensed from the machine. This tends to make the machine cheat-proof and to reduce the likelihood or possibility that something other than a shop towel, such as newspaper or the like can be inserted or that more than one towel can be obtained for each towel inserted.

SUMMARY OF THE INVENTION

In a vending machine for fabric like articles the arrangement in the input, inspection portion of the machine wherein a measuring wheel which is rotated by an input towel actuates a measuring member such as a chain which operates against a spring when it is wound upon a sprocket and actuates switches to sense the entry of the towel and to inspect the towel prior to activating the output or delivery section of the machine.

In the previously mentioned machine, the discharge or output section of the machine employs a continuously operating conveyor belt provided with pickup means to receive towels continuously delivered from a lower towel belt and to deliver the towels to a dispensing, shedding or separation arrangement which employs a transfer roll and a discharge roll operating beneath a transfer belt and wherein the transfer roll is provided with reverse points or card-cloth arrangement to assist in separating towels.

An object of this invention is to provide a means for sensing the input of a proper towel and for activating the discharge portion of a towel vending machine.

Another object of this invention resides in the delivery or discharge portion of the machine wherein towels are still loaded loosely and in bulk and the shedding arrangement employs reverse teeth or card cloth on a transfer roll acting in conjunction with a transfer belt.

Another object of the present invention is found in the specific arrangement of the shedding arrangement or separation device wherein a bottom conveyor belt beneath a loose stack of towels delivers to an upwardly extending conveyor which then delivers to a discharge arrrangement.

An additional object of this invention is to provide a means for preventing the delivery of more than one towel at a time even though towels are being continuously picked up from and returned to a stack of loose towels so that in loading the machine it is still only necessary to dump loose towels in the bottom of the machine.

Other and further objects and advantages of this invention will become apparent upon reading the following description of a preferred embodiment taken in conjunction with the accompanying drawings.

DESCRIPTION OF A PREFERRED EMBODIMENT

Figure 1:
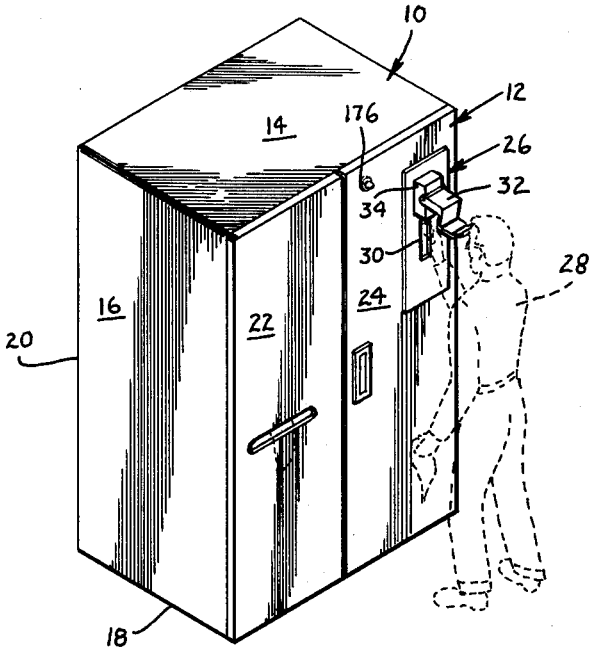
FIG. 1 is a perspective view of the closed cabinet illustrating how a dirty towel is inserted into the machine.
Figure 3:
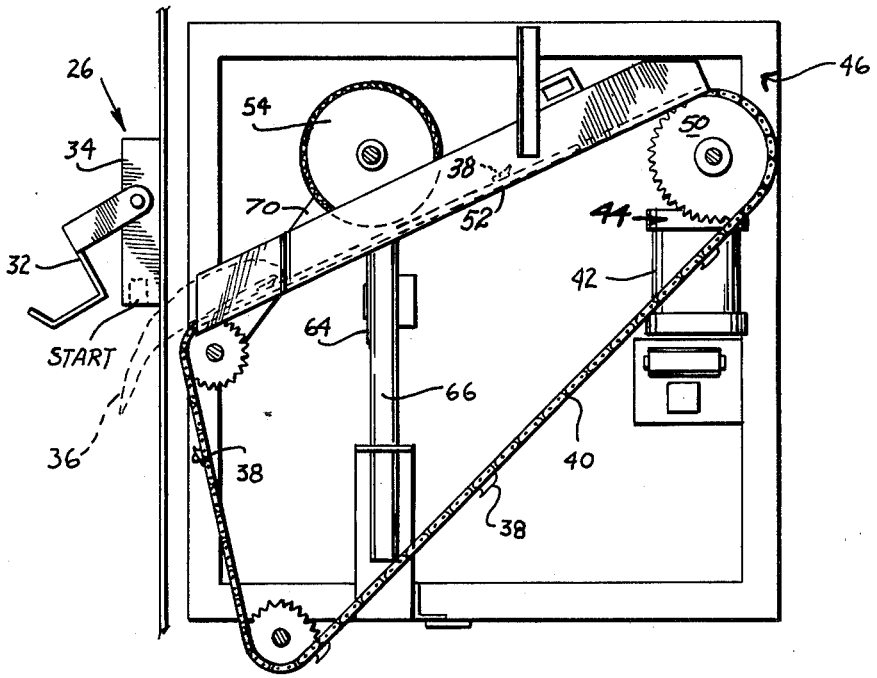
FIG. 3 is a side elevation view of the input or receiver unit secton of the present machine. .
Figure 4:
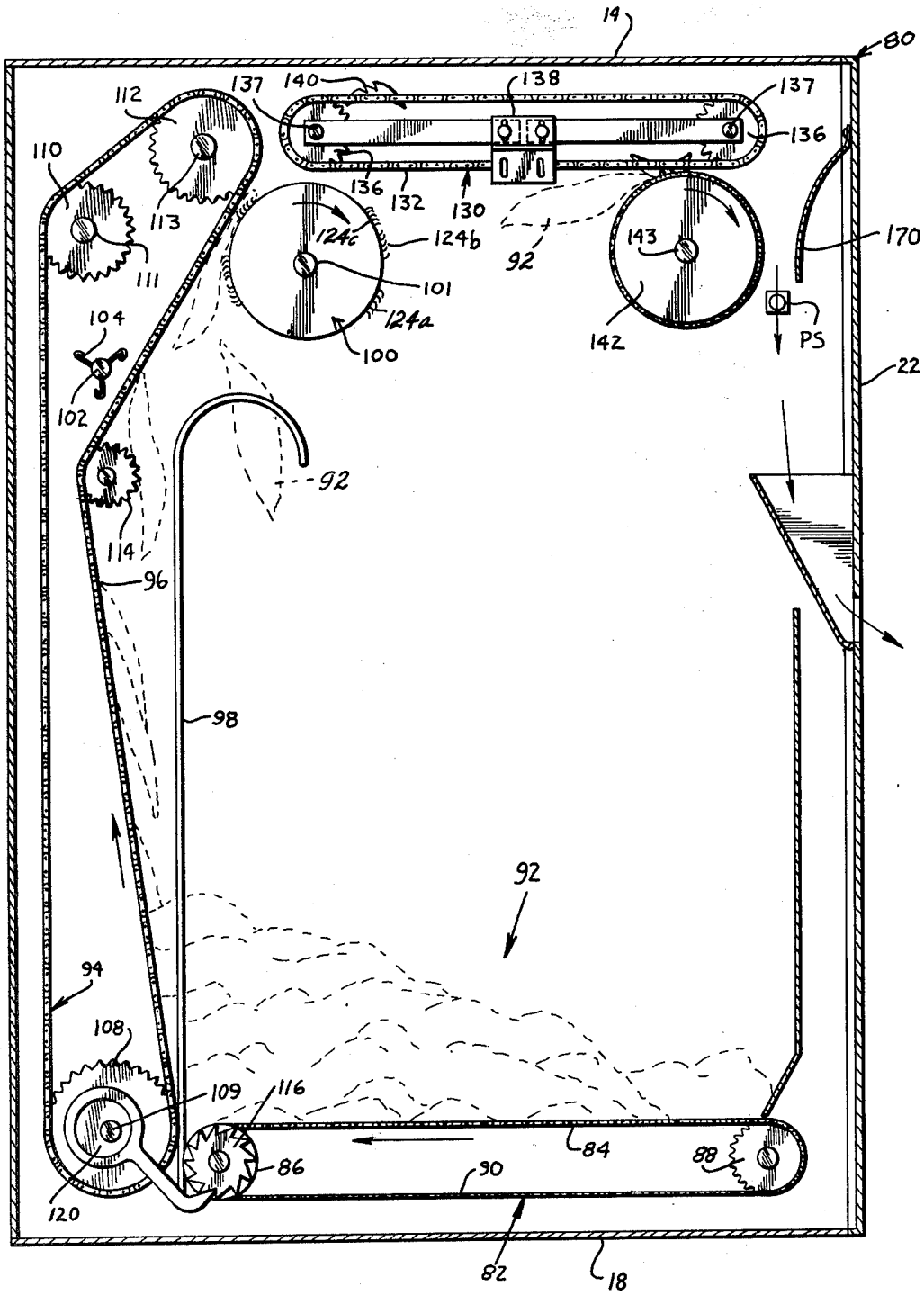
FIG. 4 is a side elevation view of the cabinet shown in FIG. 2 with a side of the cabinet broken away exposing the details of the delivery section of the machine.

The complete towel vending machine 10 comprises a cabinet or housing 12 having a top 14, sides 16, a bottom 18 and a back 20. Separate front doors 22, 24 form a common locked front closure on which there is a single towel insertion arrangement and in FIG. 1 there is shown a dotted person 28 in the act of inserting a dirty towel by placing it through slot 30 after first lifting the pivoted safety door 32 which as seen also in FIG. 3 is pivoted on a box 34 in which there is a limit switch LS START which is actuated and operated upon the closure of the door cover 32. This closes the intake opening slot 30 and excludes the possibility of injury to anyone using the machine by having their fingers in the area of the exposed moving parts of the soiled towel intake mechanism because the door cover 32 can only be closed to start the machine after the person's fingers have been removed.

The dirty towel 36, referring to FIG. 3, is inserted on one of many pins 38 attached at spaced locations along a continuously moving input chain 40 driven from a motor 42 of a motor transmission unit 44 attached to a frame 46 constructed of various rigid frame members in three dimensional form whereby the entire input mechanism may be removed from the machine similar to that arrangement disclosed in prior U.S. Pat. No. 3,974,148. Motor transmission unit 44 drives a drive sprocket 50 to rotate chain 40 in a recieving trough or channel 52 so as to elongate the dirty towel 86 beneath a measuring wheel having a knobby or roughened surface of rubber or the like against which a reel fabric towel operates as to thickness and bulk to turn the wheel 54 which is mounted on a shaft 56 on which there is a measuring sprocket 58 on which is mounted a predetermined measuring chain 60 engaged with the sprocket to wind and unwind in response to the movement of the measuring wheel 54 so that the chain moves upwardly and downwardly and carries therewith switch actuators 62, 63 which actuate and opens a limit switch STOP LS thus deenergizing motor 42 which is indicated on the schematic electrical diagram as MS 1. There are two switch actuators which are attachment links in the measuring chain 60 and as chain 60 rolls it contacts the switch STOP LS which is adjustably mounted in a slot in a plate 64.

The measuring chain 60 operates in a tube 66 in which there is fastened a coil spring 68 attached to the end of the measuring chain 60 whereby upon rolling the chain around the measuring sprocket 58 in response to the movement of the towel beneath the measuring wheel 54 the spring 68 is extended so that after the dirty towel 36 is moved from under the measuring wheel 54 spring 68 returns the wheel 54 and the chain 60 to original position ready to receive another soiled towel to start a new cycle. The shaft 56, measuring sprocket 58 and measuring wheel 54 are all mounted on a movable arm 70 which pivots up and down carrying all of these components as the soiled towel 36 progresses beneath the measuring wheel 54. The upward movement of the arm 70 is coordinated, timed and synchronized with the contacting of the STOP LS switches so that the bulk of the thickness of the towel 36 is sensed as it passes through the channel 52 particularly sensing the greater bulk when the two outside corners of the soiled towel 36 passes.

Figure 5:
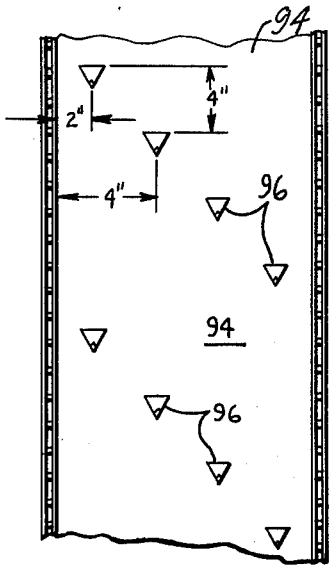
FIG. 5 is a plan view of a portion of the pickup conveyor for the clean towels.

The dispensing section of the machine which is reached through door 22 has therein a removable dispensing unit 80 which is mounted on a three dimensional frame comprising various longitudinal, vertical and transverse frame members on which there is mounted a lower towel feed belt arrangement 82 comprising a wide belt 84 of canvas, nylon material, rubber or the like which continuously moves around a pair of spaced sprockets 86, 88 which engage with chains 90 on each side of the feed belt 84. A stack of towels 92 is placed on top of the belt 84 and loading is simple and easy requiring only that towels be thrown or dumped into the cabinet 12. The lower feed belt 84 slowly feeds the towels 92 into an elevating belt 94 which is shown in face or plan view in FIG. 5 and comprises a plurality of lugs or pickup members 96 each having a pin which will engage and pick up a towel 92. Vertical separator rods 98, having some flexibility, are arranged in spaced relationship transversely across the cabinet portion of the dispensing section, as readily seen in FIG. 2, and serve to assure within percentages of performance that as few towels as possible are hooked on two of the pickup members 96 when reaching the transfer roll 100. Separator rods 98 also serve to reduce any masses of towels being drawn under the transfer roll 100 when clean storage is overfilled or even when normally full. A vibrator 102 has vibrator contact members or arms 104 which contact the elevating belt 94 and serve to shake off excess towels which are on the lugs or pickup members 96. A typical elevating belt would be 150 inches long and would have 32 lugs in repeat patterns of 4 each as shown in FIG. 5. The belt 94 is driven by means of side chains 106 in a continuous fashion about a lower sprocket 108 and spaced upper sprockets 110, 112 mounted on respective shafts. There is also an idler sprocket 114 located outside the belt 94 behind the vertical rod 98.

The sprocket 86 on lower feed belt arrangement 82 is driven by means of a ratchet 116 which is operated by a drive ratchet 118 driven by an eccentric cam 120 located on the shaft of sprocket 108.

Figure 6:
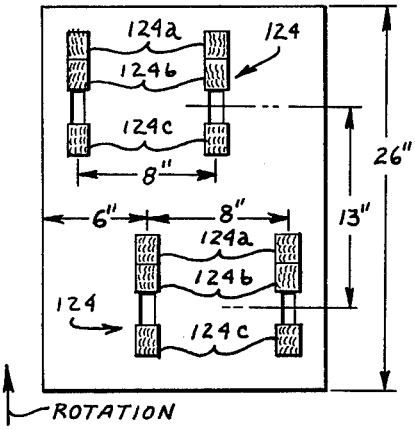
FIG. 6 is a plan view of the surface of the transfer roll laid out flat to show the relationship of the pickup needles.

The transfer roll 100 is provided with card cloth arranged in a certain way as shown in FIG. 6. Card cloth is a well known and common material in the textile trade and in the carding of fibers and comprises cloth or backing material with a plurality of needles which may be bent on the end in one direction or another. The card cloth is arranged in individual card patches 124 which are shown in more detail in FIG. 6 and are arranged so that a first section card 124A is positioned to pick up a towel 92 on one of the pickup members 96 of the belt 94 and a second card patch 124B is positioned with its points in the opposite direction. If the first section card patch 124A has picked up two towels from the belt 94 when the transfer roll 100 moves towels 92 to the top vertical position the separation of the two towels 92 will occur because of cooperation with a transfer belt arrangement 130.

Figure 7:
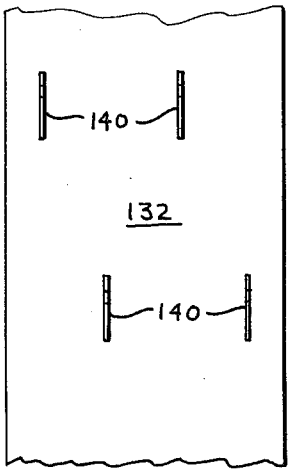
FIG. 7 is a flat plan view of the surface of the top transfer belt showing the pickup pins thereon.

Transfer belt arrangement 130 is shown in flat or plan view in FIG. 7 and comprises a flat belt 132 of any suitable material such as canvas, rubber or the like, having chains 134 on the opposite sides and edges thereof which are driven by respective spaced sprockets 136 all adjustably mounted and located by means of a support bracket arrangement 138. There are a plurality of pickup teeth or pins 140 located in spaced relationship, as seen in FIG. 7.

Figure 2:
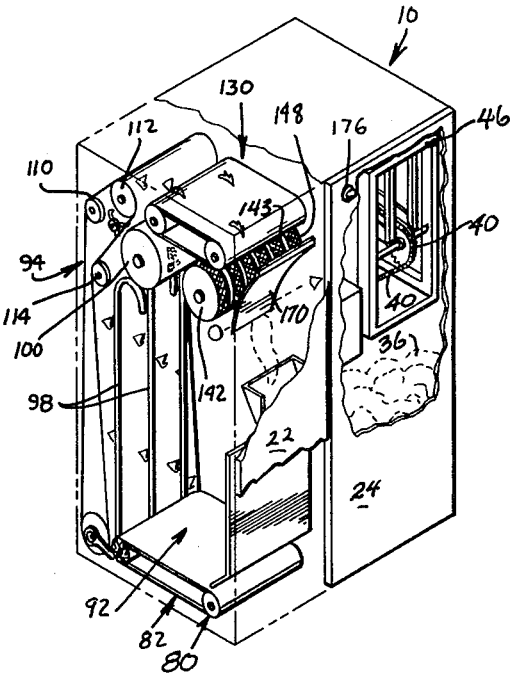
FIG. 2 is a perspective view similar to FIG. 1 but with portions of the machine broken away to illustrate the details.

There is a discharge roll 142 spaced from the transfer roll 100 beneath the transfer belt arrangement 130 and the surface of the transfer roll is covered with a knobby or knubby material as shown in FIG. 2 and which may be rubber, plastic or the like arranged in surfaces with space therebetween.

Figure 8:
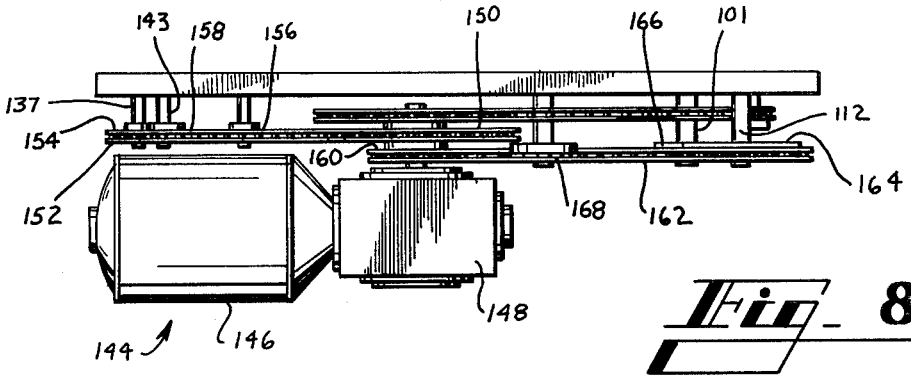
FIG. 8 is a top plan view of the drive mechanism for the power pickup and delivery mechanism.
Figure 9:
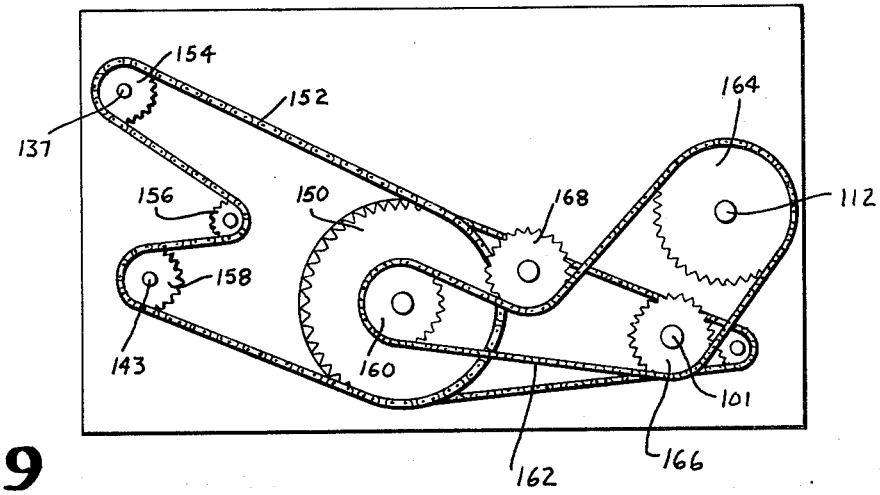
FIG. 9 is a side elevation view of the drive mechanism shown in FIG. 8.

A motor transmission unit 144 mounted on the dispensing unit 80 comprises a motor 146 connected to a transmission 148 for driving the elevating belt, transfer belt, transfer roll 100 and discharge roll 142. As seen in FIGS. 8 and 9, a large drive sprocket 150 is driven from an output shaft or transmission 148 and has a continuous chain 152 therearound which also passes around a transfer belt sprocket 154, an idler sprocket 156 and a discharge roll 142 sprocket 158. Another smaller drive sprocket 160 on the shaft of the output transmission 148 has a continuous chain 162 thereon which passes about and drives an elevating belt sprocket 164, the transfer roll 100 sprocket 166 and an idler sprocket 168.

A transfer roll 100 rotates 180 degrees for each of the pickup members 96 on the elevating belt 94 and is so timed that the correct card cloth patch 124 on the transfer roll 100 takes the towel 92 (if one is present) off the corresponding pickup member 96 on the belt 94. As mentioned previously, if two towels have been picked up on the pickup member 96 the transfer belt 132 engages the top towel 92 of the two towels, the second towel which is underneath will be held momentarily by the second card patch **124*b*. As the pickup member 96 moves away with the top towel 92 the second towel continues with the rotation of the transfer roll 100 carried in part by the third card patch 124*c* until it reaches a point where it is released by the second card patch 124 and is returned to the mass of clean towels 92. When the pickup member 96 carries the towel to the discharge roll 142 the discharge roll 142 rapidly removes the towel 92 from the pickup member 96 striking a deflection plate 170** then falling past a photo electric cell PS which is a photo electric detector that operates the switch to break the operation of the clean towel delivery section.

Figure 10:
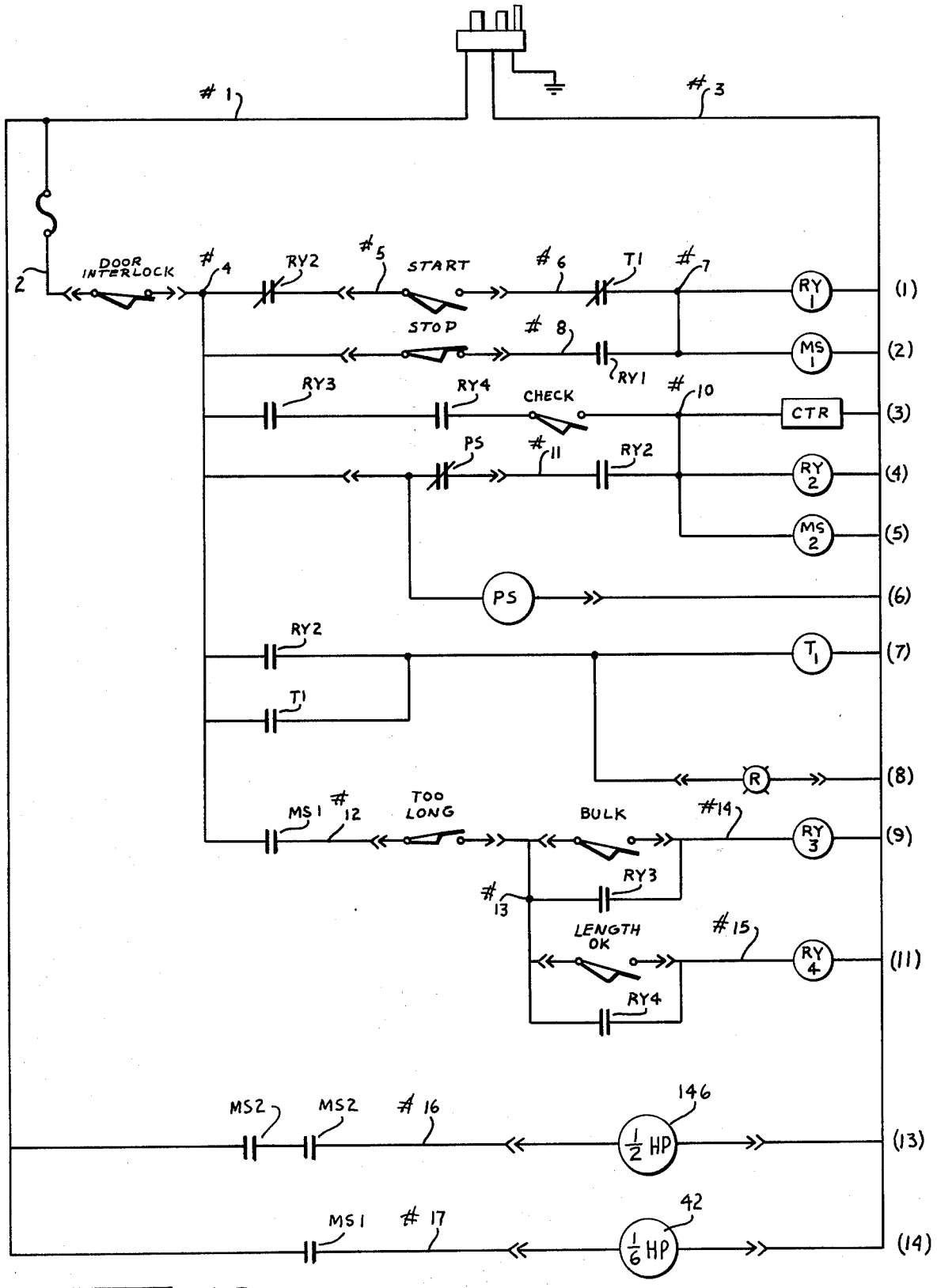
FIG. 10 is a schematic electrical diagram of the electrical components of the machine including the input and dispensing portions.
Figure 12:
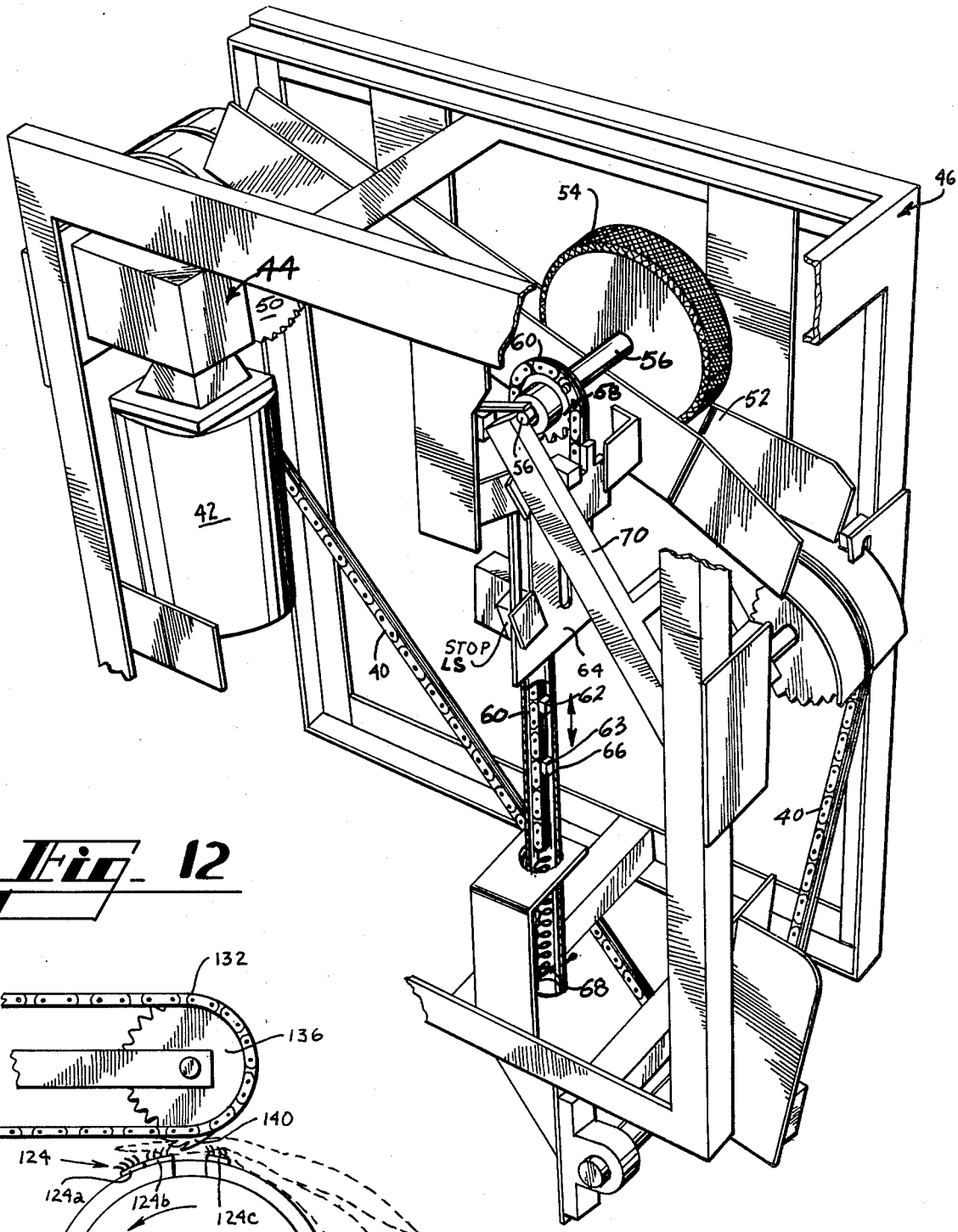
FIG. 12 is a perspective view of part of the receiving section inspection and measuring arragement for examining a dirty towel prior to issuing a clean one.
Figure 11:
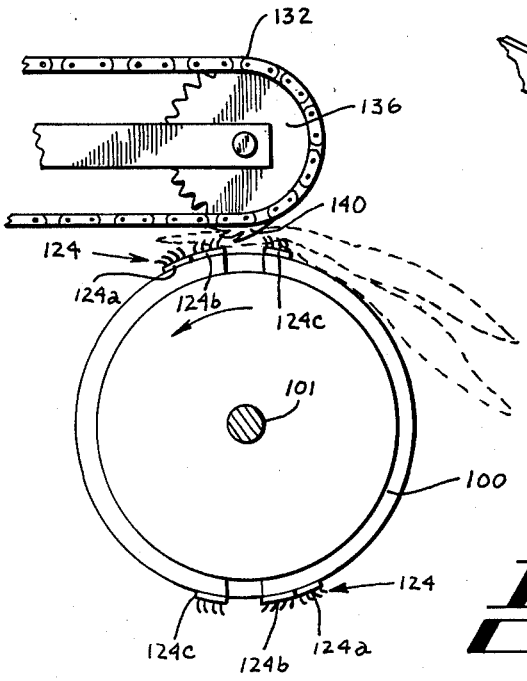
FIG. 11 is an enlarged side elevation view of part of the transfer belt and transfer roll for separating more than one towel so that only one is dispensed.

In FIG. 6 there is a flat layout of the skin or surface of the transfer roll 100. Previously it was mentioned that the discharge roll 142 is provided with spaces or spaced grooves 143 at intervals along the length thereof as readily seen in FIG. 2. Referring to FIG. 10, as well as FIG. 6, the needles or pins 125 in the different sections or segments of the card cloth **124*a*, 124*b*, and 124*c* are indicated in larger detail with reference to the direction of rotation of the transfer roll 100 and in FIG. 10 this is clearly seen in conjunction with the transfer belt arrangement 130 and particularly the elements 140 which possess teeth or similar sharp projections. The transfer points of the clean towels 92 are timed to synchronize with one another. The card patch 124 and the respective segments 124*a*, 124*b*, and 124*c* is timed to pickup the towel 92 on the pickup members 96 and is timed to deliver the towel 92 to an exact meeting and transfer to the element or segment having the teeth 140. The meeting between the teeth 140 on the transfer belt 132 and the transfer roll 142 is synchronized so that the teeth 140 extend below the surface of the transfer roll 142 at the transfer point by entering the cutout section of the roll 142 between the second card patch 124*b* and the third card patch 124*c* thereby assuring positive engagement of the teeth 140 with the towel 92 to be picked up. This synchronization of these various components is accomplished by the power train which is illustrated in FIGS. 8 and 9. Each succeeding transfer point is moving at a greater speed than the previous one and this does two things — (1) it speeds delivery of the clean towel and (2) it is part of the towel separation process. Thus, the transfer roll 100 rotates 180 degrees for each of the pickup members 96 on the elevating belt 94 and is timed so that the correct card cloth patch 124 on the transfer roll 100 takes the towel 92 (if one is present) off the corresponding pickup member 96** on the belt.

DESCRIPTION OF THE CIRCUIT DIAGRAM AND OPERATION—FIG. 10

Wires #1 and #3 are the 110V. power source. Wire #3 becomes "common" to all components requiring 110V. to operate. #1 supplies the power to both motors and to the fuse. It then becomes wire #2 which goes thru a door interlock DLS (LIMIT SWITCH) to the contr-1 circuit as wire #4 on line (1) of diagram.

Next on line (1) are NC (normally closed) RY2 (RELAY #2) contacts. If these contacts are open, it indicates that the dispensing LEFT section is still running and thus it is not possible to enter a soiled towel. Next is START LS — this is the LIMIT SWITCH actuated by closing the small soiled towel door. Next are the TI (TIMER #1) which is the only one NC (normally closed) contacts. If these contacts TI are open it means that the machine is low on towels and must be refilled. TIMER TI will reset when door INTERLOCK DLS opens. When the door closes RY1 is energized.

At the same time, on line (2), MS1 (MOTOR STARTER #1) is energized and NO (normally open) RY1 contacts close, thus sealing the circuit thru NC STOP LS. The STOP LIMIT SWITCH is mounted so that a properly located cam lug on the infeed input chain 40 will open STOP LS (thus deenergizing RY1 and MS1 with the chain 40 in a proper position to receive the next soiled towel.

On line (3) there is CHECK LS which must close momentarily to energize the clean towel components. The CHECK LS SWITCH is mounted so as to activate just prior to (and in the same way) as the above STOP LS. On this line (3) note that NO (normally open) contacts RY3 and RY4 must be closed also.

In lines (9), (10), (11), and (12) BULKS LIMIT SWITCH is mounted in such a way as to detect the "UP" and "DOWN" movement of the inspection measuring wheel 54. If the towel 36 being inspected has sufficient BULK RY3 is energized and sealed in thru NO RY3 contacts line (10).

The short spring-loaded chain 60 attached to the inspection measuring wheel 40 has movement relative to the length of the towel 36 being inspected. It also has the cam lug switch actuator 62 so that a towel 36 of proper length will actuate LENGTH LS. This closes RY4 and it is sealed in thru RY4 contacts—line (12).

If the towel 36 is too long, it moves the cam lug 62 far enough to open a TOO LONG LS, thus dropping out both RY3 and RY4 — both of which must be energized to close the NO (normally open) RY3 and RY4 contacts on line (3) to start the clean towel section.

If the towel 36 is "OK", when CHECK LS closes the counter RY2 and MS2 are energized and sealed in thru NO RY2 contacts and NC PS (PHOTO-SWITCH) contacts. When a clean towel 92 is delivered the PS line (6) opens the NC PS contacts, RY2 and MS2 drop out and the counter counts. Thus a cycle is completed.

When RY2 contacts close, the TI TIMER on line (7) is energized and it starts to time on every cycle. If a towel is delivered before it "times out" (about 40 seconds) nothing happens. If it "times out", NO TI contacts close and the timer TI seals in; however, the unit will run until a towel is delivered. Then the TIMER TI is "sealed" in and NO TI contacts on line (1) are open. Thus a soiled towel will not be accepted. A red light 176 on the door warns that the machine must be filled.

Opening the doors 22, 24 opens DOOR INTERLOCK LS and TIMER #1 drops out. When the doors 22, 24 again are closed the circuit should be in the "Go" mode.

While I have shown and described a particular embodiment of this invention together with a suggested mode of operation this is by way of illustration only and does not constitute any sort of limitation on the scope of the invention as there are various alterations, changes, eliminations, deviations, substitutions, departures and revisions which may be made in the embodiment described without departing from the scope of the claims as defined only by a proper interpretation thereof.

What is claimed is:

1. In a dispensing machine for receiving and examining an article such as a soiled shop towel prior to dispensing a clean one and wherein there is a normally closed cabinet or housing in which there is a place for storage of soiled towels which have been inserted into the machine and a place for storage and dispensing clean towels and wherein there is a slot or opening in the housing through which a clean towel may be positioned on a continuously driven conveyor means having a plurality of spaced positions thereon on which a towel is inserted, there being a measuring wheel continuously contacted by the movement of said article, the improvement comprising:

supporting said measuring wheel for movement in response to the travel of said article as said article such as the shop towel is elongated by said conveyor means, an elongated measuring member and means connecting said measuring wheel to said measuring member so that said measuring member is displaced in response to the movement, means for returning said measuring member to initial position after displacement.

2. The device in claim 1:

switch actuation means on said measuring member operable to contact a switch upon predetermined displacement of said measuring member, switch actuation means located to be contacted by said switch actuator.

3. The device in claim 1 wherein said means for returning said measuring wheel is a spring.

4. The device in claim 1 wherein said elongated measuring member is a chain and the means connecting said measuring wheel includes a sprocket about which said measuring member is moved.

5. The arrangement claimed in claim 1 wherein there is a safety device on said machine comprising a closure movably mounted on said door to cover the slot through which the article is inserted, said closure normally covering the opening but being movable manually out of position for the insertion of an article, switch means having a switch contact operated by said closure upon closing same after inserting the towel, and circuit means operable to prevent further operation of the machine until the closure is closed.

6. The device in claim 1 wherein said measuring wheel is pivotally mounted on said machine as well as being rotatable thereon.

7. The device claimed in claim 1 wherein said measuring wheel is mounted on a shaft, a sprocket on said shaft, said measuring member being a chain extending over and attached to said sprocket to be wound thereon during movement of said measuring chain.

8. The device in claim 7 wherein said means for returning said measuring wheel is a spring actuated by said measuring member.

9. The device claimed in claim 3 wherein said claim includes an attachment link having switch contact members thereon, and means movably mounted on said switch contact means for adjustment to make allowance for differences in length and bulk of articles to be received.

10. The device in claim 8 wherein said spring is a coil spring having one end attached to said chain and the other end attached to a fixed position on said machine.

11. The device claimed in claim 10 wherein there is a tube on said machine which is at least partially closed, said measuring chain extending into said tube through the length of part thereof, said spring being a coil spring which is mounted in said tube and having one end fixed to the machine and the other end attached to said measuring chain so that the winding of said measuring chain on said sprocket elongates said spring.

12. In a dispensing machine for dispensing a fabric-like article, such as a shop towel, and wherein there is a normally closed cabinet or housing in which there is a place for storage and dispensing articles, the improvement comprising:

a dispensing unit having a lower article feed means whereby articles may be fed from a pile, an elevating means on said machine for elevating said articles, means for driving said elevating means in a continuous fashion, a transfer roll having spaced projecting members arranged thereon, said projecting members extending in opposite directions, an upper transfer means having a plurality of pickup projections thereon extending therefrom, a discharge means spaced from the transfer means, said elevating means being a belt having pickup members, said transfer roll rotating 180° for each of the pickup members on the elevating belt and being timed so that some of the projecting members on the transfer roll takes a towel (if one is present) from the corresponding pickup member on the belt so that if two towels have been picked up on the pickup member the transfer belt engages the top towel of the two towels and the second towel which is underneath will be held momentarily by the projecting members, one of said pickup members moving away with the top towel and the second towel continuing with the rotation of the transfer roll carried in part by the projecting members until it reaches a point where it is released by the projecting members and returned to the mass of clean towels whereupon when the pickup member carries the towel to the discharge roll, the discharge roll rapidly removes the towel from the pickup member striking a deflection plate and moving past a photo electric cell to stop the operation of the clean towel delivery.

13. The device claimed in claim 12 wherein said upper transfer means is a transfer belt and the meeting between the pickup projection on the transfer belt and the transfer roll is synchronized so that the pickup projections on the transfer belt extend below the surface of the transfer roll at the transfer point by entering the spaced section of the transfer roll at a point between the projecting members on the transfer roll thereby reassuring positive engagement of the teeth with the towel to be picked up.

14. The device claimed in claim 12 wherein there are vertical separator rods spaced from said pickup pins and having flexibility so that as few towels as possible are hooked into each pickup pin and also preventing masses of towels being drawn upwardly.

15. The device in claim 14: vibrator means for contacting the elevating belt to shake off excess towels.

16. The device claimed in claim 15 wherein each succeeding transfer point is moving at a greater speed than the previous one thereby speeding delivery of the clean towel and aiding in the towel separation process.

17. In the device claimed in claim 16, an electric power means for said input of said machine and for said output of said machine, a manual start switch on said machine, relay means on said machine employing relay contacts which are maintained open to indicate that the dispensing section is running in order to prevent the receipt of a soiled towel, a limit switch on said machine indicating that the machine is low on towels and must be refilled, a limit switch actuatable by said measuring chain, a bulk limit switch mounted in such a way as to the up and down movement of the inspection measuring wheel, a too long limit switch mounted on said machine actuatable by an article that is too long thereby preventing dispensing of the clean towel.

18. In a method for dispensing fabric-like articles such as shop towels, one article at a time, from a pile of many individual fabric-like articles, comprising:

conveying articles from the bottom of the pile so that the articles may be elevated above the pile, elevating the articles in spaced relationship with one another by engaging the pile at spaced locations and lifting the articles upwardly, delivering the elevated towels to a discharge point above the stack, engaging the towels with a plurality of protruding members extending in one direction and then engaging any additional towel which has been picked up with said first towel with projecting members extending in another direction thereby separating one towel from another and causing the lowermost towel to fall back into the pile, engaging said first towel by a transfer means which is traveling at a greater rate of speed and engaging said first towel with projections on said transfer means transferring said towel to a discharge means, engaging said towel between the transfer means and the discharge means to be dispensed.

19. In a dispensing machine for dispensing a fabric-like article, such as a shop towel, and wherein there is a normally closed cabinet or housing in which there is a place for storage and dispensing articles, the improvement comprising:

a dispensing unit having a lower article feed means whereby articles may be fed from a pile, said lower article feed means comprising a feed belt arrangement having a wide belt and drive chain means for said belt, an elevating means on said machine for elevating said articles, said elevating means comprising a plurality of pickup members each having a pin engageable at different locations, means for driving said elevating means in a continuous fashion, a transfer roll having spaced card cloth patches comprising projecting members arranged thereon, said projecting members extending in opposite directions from said card cloth and said transfer roll, an upper transfer means having a plurality of pickup members thereon extending therefrom, and a discharge means spaced from the transfer means.

20. The device claimed in claim 19 wherein said upper transfer means comprises a transfer belt comprising a flat belt of suitable material, drive means for driving said transfer belt, said transfer belt having said plurality of pickup members thereon extending therefrom.

21. The device claimed in claim 20, said discharge means comprising a discharge roll spaced from the transfer means.

22. The device claimed in claim 21, said discharge roll having a roughened surface with a plurality of spaces at locations thereon extending circumferentially around the periphery thereof.

23. The device claimed in claim 13: said projecting members being on card patches on said transfer roll, there being first, second and third card patches spaced on said transfer roll, said second towel being held momentarily by said second card patch and with said third card patch until released.

* * * * *